US009211585B2

(12) United States Patent
Funato et al.

(10) Patent No.: US 9,211,585 B2
(45) Date of Patent: Dec. 15, 2015

(54) PLATE FIXING STRUCTURE AND PLATE

(75) Inventors: Junichi Funato, Fukuoka (JP); Shunji Sadano, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 232 days.

(21) Appl. No.: 14/007,512

(22) PCT Filed: Mar. 23, 2012

(86) PCT No.: PCT/JP2012/057505

§ 371 (c)(1),
(2), (4) Date: Dec. 30, 2013

(87) PCT Pub. No.: WO2012/133181

PCT Pub. Date: Apr. 10, 2012

(65) Prior Publication Data

US 2014/0263483 A1 Sep. 18, 2014

(30) Foreign Application Priority Data

Mar. 30, 2011 (JP) ..... 2011-075695

(51) Int. Cl.
*B22D 41/34* (2006.01)

(52) U.S. Cl.
CPC ..... *B22D 41/34* (2013.01)

(58) Field of Classification Search
CPC ..... B22D 41/32; B22D 41/34
USPC ..... 222/600
See application file for complete search history.

(56) References Cited

U.S. PATENT DOCUMENTS 4,763,881 A * 8/1988 Wenger ..... 266/287
8,152,033 B2 4/2012 Funato et al.
D698,376 S * 1/2014 Funato et al. ..... D15/138
2008/0272157 A1 11/2008 Kondo et al.
2010/0147905 A1 6/2010 Keller
2010/0200619 A1 8/2010 Funato et al.
2014/0263483 A1* 9/2014 Funato et al. ..... 222/597

FOREIGN PATENT DOCUMENTS

CA 2559930 9/2005
CN 101139640 3/2008
CN 101588882 11/2009

(Continued)

OTHER PUBLICATIONS

Office Action dated Oct. 10, 2014 for Chinese Application No. 201280016354.4.
English translation of Office Action dated Oct. 10, 2014 for Chinese Application No. 201280016354.4.
Translation of International Search Report (ISR) published on Apr. 10, 2012 for International Patent Application No. PCT/JP2012/57505 filed on Mar. 23, 2011.

(Continued)

*Primary Examiner* — Scott Kastler
(74) *Attorney, Agent, or Firm* — Fleit Gibbons Gutman Bongini & Bianco PL; Martin Fleit; Paul D. Bianco

(57) ABSTRACT

The invention provides a plate-fixing structure designed for use with a sliding nozzle device to fix a plate to a plate-receiving metal frame. The plate-fixing structure is usable in a concavo-convex fitting technique with respect to fitting a convex or concave portion of a plate to a corresponding convex or concave portion of a plate-receiving metal frame to easily achieve alignment between the convex or concave portion of the plate and the corresponding convex or concave portion of the plate-receiving metal frame. A plate for use with the plate-fixing structure is also provided.

11 Claims, 6 Drawing Sheets

(56) References Cited

FOREIGN PATENT DOCUMENTS

| | | |
|---|---|---|
| CN | 101631633 | 1/2010 |
| JP | 52-115607 | 9/1977 |
| JP | 03-120951 | 12/1991 |
| JP | H0839234 | 2/1996 |
| JP | H09122898 | 5/1997 |
| JP | H09206920 | 8/1997 |
| JP | H09277026 | 10/1997 |
| JP | H105986 | 1/1998 |
| JP | 2005262289 | 9/2005 |
| WO | 2008111508 | 9/2008 |

OTHER PUBLICATIONS

Written Opinion (WO) dated Apr. 17, 2012 for International Patent Application No. PCT/JP2012/057505 filed on Mar. 23, 2011.

English translation of the Written Opinion (WO) published Oct. 2, 2013 for International Patent Application No. JP2012057505 filed on Mar. 23, 2012.

English translation of International Preliminary Report on Patentability (IPRP) published Oct. 8, 2013 for International Patent Application No. JP2012057505 filed on Mar. 23, 2012.

* cited by examiner (a)

(b)

PLATE FIXING STRUCTURE AND PLATE

TECHNICAL FIELD

The present invention relates to a structure designed for a sliding nozzle device to fix a plate to a plate-receiving metal frame, and a plate for use in the fixing structure.

BACKGROUND ART

A sliding nozzle device is widely used in a molten metal vessel such as a ladle or a tundish, because of its advantage of being able to accurately control a flow rate of molten metal. The sliding nozzle device comprises: a fixed metal frame fixed to a bottom of a molten metal vessel; an opening-closing metal frame coupled to the fixed metal frame in an openable and closable manner; and a sliding metal frame installed to the opening-closing metal frame in a slidable manner, wherein two or three plates are attached and fixed to these metal frames, and a contact pressure is applied between the plates, whereafter the sliding metal frame is slidingly moved by a driving mechanism such as a hydraulic cylinder to thereby control a flow rate of molten metal during pouring. As the plate, a type in which a metal band, such as a strip or hoop made of a metal, is provided on a side (peripheral) surface of a plate-like refractory plate member having a nozzle hole, and an expansion absorbing material and a backplate are provided on a back surface of the refractory plate member, and a type in which the side surface and the back surface of the refractory plate member is covered by a box-shaped metal casing, are commonly used.

In such a sliding nozzle device, a technique of fixing the plate to a plate-receiving metal plate (which is a general term for the fixed metal frame, the opening-closing metal frame and the sliding metal frame; this is also applied to the following description) is toughly classified into two of the following. One is a technique of to fixing a plate by pressing a side (peripheral) surface thereof using a bolt, cotter or the like, thereby receiving a sliding force by such a fixing structure (e.g., the following Patent Document 1), and the other is a technique of fixing a plate by fitting together a fitting convex or concave portion provided in a back surface (non-sliding surface) of the plate, and a counterpart, fitting concave or convex portion provided in a plate-receiving metal frame, thereby receiving a sliding force by such a fixing structure (e.g., the following Patent Document 2). The term "back surface" of a plate means a surface of the plate on a side opposite to a sliding surface thereof capable of being slidingly moved with respect to another plate.

Generally, a plate is replaced with a new one after several usage cycles. During the replacement work, the plate-receiving metal frame is opened and set to extend vertically, and, in this state, the old plate is detached and then a new plate is attached. Thus, in the technique using a bolt or cotter, it is necessary for a worker to tighten the bolt or cotter with one of his/her hands, while holding the plate with the other hand so as not to drop off, so that there is a problem that it needs to take a lot of time and effort.

In the technique of fitting a plate into a plate-receiving metal frame as in the Patent Document 2, actually, it is also necessary to take a lot of time and effort. This is because, considering that an increase in gap between the fitting convex or concave portion of the plate and the fitting concave or convex portion of the plate-receiving metal frame in a sliding direction of the plate leads to deterioration in accuracy of adjustment of an opening degree of the nozzle hole, the gap is set to a small value of about 0.5 mm. That is, due to the small gap, it is difficult to achieve an alignment between the fitting convex or concave portion of the plate and the fitting concave or convex portion of the plate-receiving metal frame, or it is necessary to take a lot of time and effort for achieving the alignment. Moreover, the fitting convex portion and the fitting concave portion are located on the side of the back surface of the plate, so that a worker cannot perform position adjustment while visually checking them, which makes it more difficult to achieve the alignment.

The following Parent Document 3 describes a plate fixing technique which is based on the technique of fitting a plate into a plate-receiving metal frame as in the Patent Document 2, wherein a thin plate spring is provided between the plate and the plate-receiving metal frame. The Parent Document 3 mentions that, generally, in a process of fitting the plate into the plate-receiving metal frame, a worker first inserts a lower end of the plate into the plate-receiving metal frame to put a weight of the plate on the plate-receiving metal frame, and then pushes an upper end of the plate into the plate-receiving metal frame. However, this fixing technique also has a problem that it is difficult to achieve an alignment between a fitting convex or concave portion of the plate and a counterpart, fitting concave or convex portion of the plate-receiving metal frame, for the following reason.

The plate in the Patent Document 3 comprises a refractory plate member covered by a metal casing. While this metal casing is generally produced by drawing, dimensional accuracy of drawing is lower than those of other metal working processes. For example, in a large type of plate having a length of about 450 mm, a variation of about 1 mm per overall length occurs.

Further, during drawing of the metal casing, distortion occurs in the metal casing. Moreover, when the plate is pushed into the metal casing through mortar, the metal casing is likely to be expanded. For these reasons, it is difficult to obtain a side (peripheral) surface of the metal casing as a surface perpendicular to a sliding direction of the plate. Thus, when the plate is fitted into the plate-receiving metal frame while putting the lower end of the plate on the plate-receiving metal frame, it is difficult to obtain accuracy of the alignment (parallelism) between the fitting convex or concave portion of the plate (metal casing) and the fitting concave or convex portion of the plate-receiving metal frame.

As above, for the two reasons: low dimensional accuracy of the metal casing; and distortion/deformation of the metal casing, in the technique of simply inserting the lower end of the plate into the plate-receiving metal frame to put the weight of the plate on the plate-receiving metal frame and then pushing the upper end of the plate into the plate-receiving metal frame, a variation in relative position between the fitting convex or concave portion of the plate and the fitting concave or convex portion of the plate-receiving metal frame occurs, often resulting in failing to achieve the fitting between the plate and the plate-receiving metal frame. Moreover, it is conceivable that the metal casing is subjected to finish processing for ensuring dimensional accuracy and planar accuracy of the side surface. In this case, however, it is necessary to machine the entire metal casing, so that a finishing surface area becomes large, causing an increase in cost. It is also conceivable that a metal band is provided on a side (peripheral) surface of a refractory plate member without using the metal casing. In this case, however, dimensional accuracy becomes worse than that of the metal casing, because the refractory plate member is generally subjected to burning in a production stage, and resulting burning shrinkage causes a variation in the overall length.

LIST OF PRIOR ART DOCUMENTS

Patent Documents

Patent Document 1: WO 2008/111508 A
Patent Document 2: JP 09-122898 A
Patent Document 3: JP 08-039234 A

SUMMARY OF THE INVENTION

Technical Problem

The present invention addresses a problem of, in a concavo-convex fitting technique of fitting a plate to a plate-receiving metal frame by fitting together a fitting convex or concave portion of the plate and a counterpart, fitting concave or convex portion of the plate-receiving metal frame, providing a plate fixing structure capable of achieving an alignment between the fitting convex portion and the fitting concave portion in an accurate and easy manner, and a plate for use with the fixing structure.

Solution to the Technical Problem

The present invention provides a plate fixing structure which is designed for a sliding nozzle device to fix a plate to a plate-receiving metal frame by fitting together a fitting convex or concave portion provided in a back surface region of the plate and a counterpart, fitting concave or convex portion provided in the plate-receiving metal frame, wherein the plate is provided with a first engagement portion extending outwardly from one of opposite ends thereof in a sliding direction thereof, and a second engagement portion extending outwardly from the other end; and the plate-receiving metal frame is provided with a first support portion for allowing the first engagement portion to be engaged therewith, and a second support portion for allowing the second engagement portion to be engaged therewith, and wherein the plate fixing structure is configured such that: when the first engagement portion is engaged with and supported by the first support portion, the fitting convex or concave portion of the plate and the fitting concave or convex portion of the plate-receiving metal frame positionally conform to each other in the sliding direction of the plate; and, when the second engagement portion is subsequently engaged with the second support portion, the fitting convex or concave portion of the plate and the fitting concave or convex portion of the plate-receiving metal frame positionally conform to each other in a direction perpendicular to the sliding direction of the plate.

The present invention also provides a plate for use in a plate fixing structure designed to fix the plate to a plate-receiving metal frame by fitting together a fitting convex or concave portion provided in a back surface region of the plate and a counterpart, fitting concave or convex portion provided in the plate-receiving metal frame. The plate comprises: a fitting convex or concave portion provided in a back surface region thereof and fittable to a counterpart, fitting concave or convex portion provided in the plate-receiving metal frame; a first engagement portion extending outwardly from one of opposite ends thereof in a sliding direction thereof and engageable with a first support portion of the plate-receiving metal frame; and a second first engagement portion extending outwardly from the other end and engageable with a second support portion of the plate-receiving metal frame.

Effect of the Invention

In the present invention, each of the engagement portions of the plate is provided to extend outwardly from a respective one of the opposite ends of the plate in the sliding direction, i.e., extend outwardly from a plate body (e.g., an assembly of a refractory plate member and a metal casing), so that the engagement portions can be independently finished by machining or the like easily and with a high degree of accuracy, without being affected by dimensional variation and distortion/deformation of the plate body during production. This makes it possible to easily enhance alignment accuracy in an operation of allowing the engagement portions of the plate to be engaged with the respective support portions of the plate-receiving metal frame to achieve an alignment between the fitting convex or concave portion of the plate and the fitting concave or convex portion of the plate-receiving metal frame.

Further, in the present invention, when the first engagement portion of the plate is engaged with and supported by the first support portion of the plate-receiving metal frame, the fitting convex or concave portion of the plate and the fitting concave or convex portion of the plate-receiving metal frame positionally conform to each other in the sliding direction of the plate, and when the second engagement portion of the plate is subsequently engaged with the second support portion of the plate-receiving metal frame, the fitting convex or concave portion of the plate and the fitting concave or convex portion of the plate-receiving metal frame positionally conform to each other in a direction perpendicular to the sliding direction of the plate. Thus, it becomes possible to easily achieve the alignment between the fitting convex or concave portion of the plate and the fitting concave or convex portion of the plate-receiving metal frame, by a simple operation of supportably engaging the engagement portions of the plate with the respective support portions of the plate-receiving metal frame.

DESCRIPTION OF EMBODIMENTS

With reference to the drawings, the present invention will now be described based on an embodiment thereof.

Figure 1:
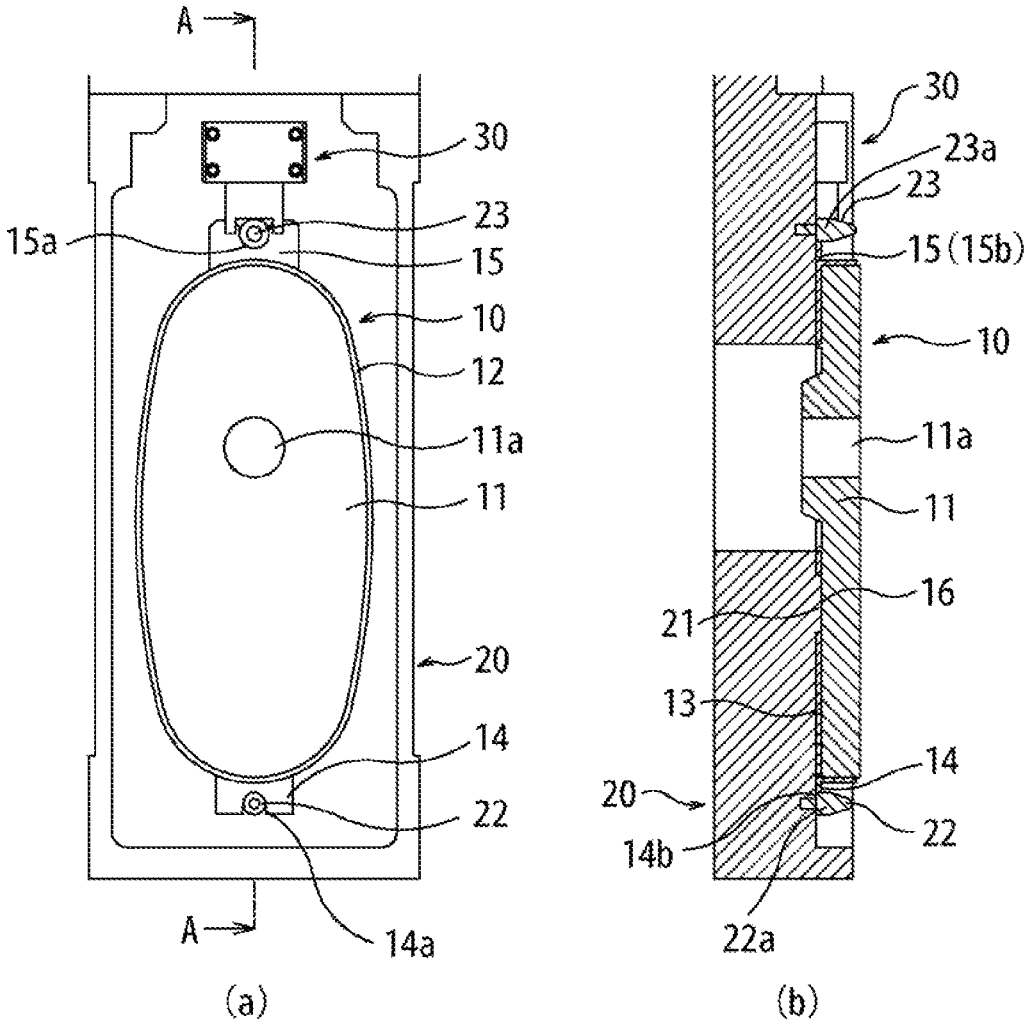
FIG. 1 illustrates a plate fixing structure according to one embodiment of the present invention, wherein FIG. 1(*a*) is a plan view of the plate fixing structure, and FIG. 1(*b*) is a sectional view taken along the line A-A in FIG. 1(*a*).
Figure 2:
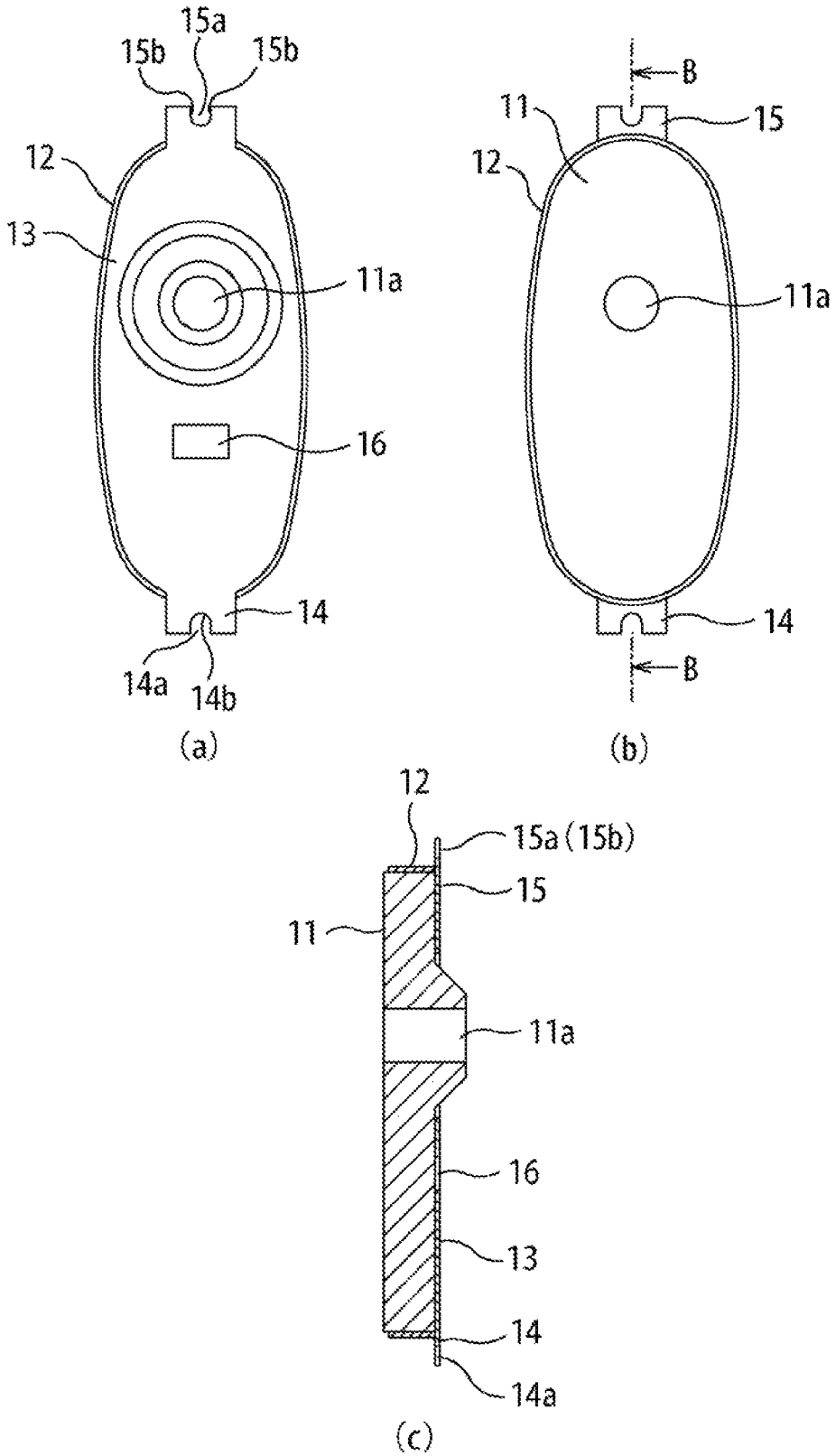
FIG. 2 illustrates details of a plate in FIG. 1, wherein FIG. 2(*a*), FIG. 2(*b*) and FIG. 2(*c*) are, respectively: a plan view of the plate, when viewed from the side of a back surface thereof; a plan view, when viewed from the side of a sliding surface thereof; and a sectional view taken along the line B-B in FIG. 2(*b*).

FIG. 1 illustrates a plate fixing structure according to one embodiment of the present invention, wherein FIG. 1(*a*) is a plan view of the plate fixing structure, and FIG. 1(*b*) is a sectional view taken along the line A-A in FIG. 1(*a*). A plate replacement work in a sliding nozzle device is performed after tilting a molten metal vessel. Thus, the sliding nozzle device is turned 90 degrees from its posture during usage to a posture where a plate extends vertically, i.e., a state in which a sliding direction of the plate becomes approximately perpendicular to a floor surface. FIG. 1 illustrates the state during the plate replacement work. FIG. 2 illustrates details of a plate in FIG. 1, wherein FIG. 2(*a*), FIG. 2(*b*) and FIG. 2(*c*) are, respectively: a plan view of the plate, when viewed from the side of a back surface thereof; a plan view, when viewed from the side of a sliding surface thereof; and a sectional view taken along the line B-B in FIG. 2(*b*).

The plate 10 is configured to used in a state in which it is received in a plate-receiving metal frame 20, and comprises: a refractory plate member 11 having a nozzle hole 11*a* for allowing molten metal to pass therethrough; a metal band 12 surrounding a side (peripheral) surface of the refractory plate member 11; a metal backplate 13 welded to the metal band 12. to cover a back surface of the refractory plate member 11; and aftermentioned first and second engagement portions 14, 15 each extending outwardly from a respective one of opposite ends of the backplate 13 in a sliding direction of the plate 10 (i.e., from a respective of sliding-directionally opposite ends of the backplate 13). A casting nozzle such as an upper nozzle or a lower nozzle is joined to the back surface of the plate 10 in such a manner as to communicate with the nozzle hole 11*a*, so that a region of the back surface to be joined with the casting nozzle is not covered by the backplate 13.

A back surface region of the plate 10 is provided with a fitting concave portion 16, and the plate-receiving metal frame 20 is provided with a fitting convex portion 21 at a position corresponding to the fitting concave portion 16 of the plate 10. The fitting concave portion 16 is formed by cutting out the backplate 13 in a rectangular shape, and defined by two opposed inner side surfaces each perpendicular to the sliding direction (in FIG. 1, an up-down direction), two opposed inner side surfaces each parallel to the sliding direction, and the back surface (non-sliding surface) of the refractory plate member 11. On the other hand, the fitting convex portion 21 of the plate-receiving metal frame 20 is formed in a rectangular shape in plan view to have two opposed side surfaces each perpendicular to the sliding direction, and two opposed side surfaces each parallel to the sliding direction. The fitting convex portion 21 has a distal edge formed as an inclined surface to allow the fitting concave portion 16 to be smoothly fitted thereon. In this embodiment, the fitting convex portion 21 is formed to have a height dimension free of causing a contact with the refractory plate member 11.

During usage, either one of the two inner side surfaces of the fitting concave portion 16 of the plate 10 each perpendicular to the sliding direction is brought into contact with a corresponding one of the two outer side surfaces of the fitting convex portion 21 of the plate-receiving metal frame 20 each perpendicular to the sliding direction, to receive a sliding force. Thus, if a gap between the fitting concave portion 16 and the fitting convex portion 21 in the sliding direction increases, accuracy of adjustment for a degree of opening of the nozzle hole 11*a* will be deteriorated. For this reason, this gap is designed to be minimized. In this embodiment, the gap between the fitting concave portion 16 and the fitting convex portion 21 in the sliding direction is set to 0.5 mm. On the other hand, a gap between the fitting concave portion 16 and the fitting convex portion 21 in a direction perpendicular to the sliding direction is not particularly limited, but may be set to ensure a sufficiently large value.

Based on the above fundamental configuration, the plate fixing structure according to this embodiment has the following configuration for facilitating position adjustment between the fitting concave portion 16 of the plate 10 and the fitting convex portion 21 of the plate-receiving metal frame 20.

Specifically, the plate 10 is provided with a first engagement portion 14 extending outwardly from one of the sliding-directionally opposite ends of the backplate 13, and a second engagement portion 15 extending outwardly from the other end. Correspondingly, the plate-receiving metal frame 20 is provided with a first protrusion 22 serving as a first support portion for allowing the first engagement portion 14 to be engaged therewith, and a second protrusion 23 serving as a second support portion for allowing the second engagement portion 15 to be engaged therewith. More specifically, the first engagement portion 14 and the second engagement portion 15 are provided, respectively, with a U-shaped groove 14*a* and a convex-shaped groove 15*a* each having an opening on a side opposite to the nozzle hole. Each of the grooves 14*a*, 15*a* is configured to be fitted into a respective one of the first and second protrusions 22, 23, thereby establishing an engagement therebetween.

A center line of the groove 14*a* of the first engagement portion 14 parallel to the sliding direction is aligned with a central axis C of the plate in the sliding direction (i.e., a longitudinal axis C of the plate 10). The first protrusion 22 is a circular columnar-shaped member made of a metal, and provided on a bottom of the plate-receiving metal frame 20 in such a manner as to have a center located on the longitudinal axis C of the plate, and extend in a direction approximately perpendicular to a sliding surface of the plate 10. In FIG. 1, the first engagement portion 14 is engaged with and supported by the first protrusion 22 in a state in which a side (peripheral) surface 22*a* of the first protrusion 22 is in contact with an inner surface 14*b* of the groove 14*a* of the first engagement portion 14. In this manner, the first engagement portion 14 is engaged with and supported by the first protrusion 22. Thus, in an operation of attaching the plate 10*b* to the plate-receiving metal frame 20, the fitting concave portion 16 of the plate 10 and the fitting convex portion 21 of the plate-receiving metal frame 20 positionally conform to each other in the sliding direction. In other words, when the first engagement portion 14 is engaged with and supported by the first protrusion 22, each of the two inner side surfaces of the fitting concave portion 16 each perpendicular to the sliding direction and a corresponding one of the two side surfaces of the fitting convex portion 21 each perpendicular to the sliding direction are positioned in a state in which respective height positions thereof conform to each other. Further, when the first engagement portion 14 is engaged with and supported by the first protrusion 22, a weight of the plate 10 is born by the first protrusion 22.

On the other hand, the groove 15*a* of the second engagement portion 15 has an inner surface including two guide surfaces 15*b* opposed to each other and each parallel to a plane perpendicular to the sliding surface of the plate 10. Further, a center line of the groove 15*a* parallel to the sliding direction is aligned with the central axis C of the plate in the sliding direction. The second protrusion 23 is a circular columnar-shaped member made of a metal, and provided on the bottom of the plate-receiving metal frame 20 in such a manner as to have a center located on the central axis C of the plate in the sliding direction, and extend in a direction approximately perpendicular to the sliding surface of the plate. A side (peripheral) surface 23*a* of the second protrusion 23 serving as a guide surface, and each of the guide surfaces 15*b* of the groove 15*a* of the second engagement portion 15, have a slight gap therebetween. The groove 15*a* of the second engagement portion 15 is configured, when the second protrusion 23 is fitted into the groove 15*a*, to position the plate in a horizontal direction (a direction perpendicular to the sliding direction, by the opposed inner guide surfaces 15*b*. That is, when the second engagement portion 15 is engaged with the second protrusion 23, the fitting concave portion 16 of the plate 10 and the fitting convex portion 21 of the plate-receiving metal frame 20 positionally conform to each other in the direction perpendicular to the sliding direction. This makes it possible to enhance accuracy of parallelism between each of the surfaces of the fitting concave portion 16 of the plate 10 perpendicular to the sliding direction and a corresponding one of the surfaces of the fitting convex portion 21 of the plate-receiving metal frame 20 perpendicular to the sliding direction.

As above, in the operation of attaching the plate 10 to the plate-receiving metal frame 20, the fitting concave portion 16 of the plate 10 positionally conform to each other in the sliding direction and in the direction perpendicular to the sliding direction by supportably engaging the first engagement portion 14 with and supported the first protrusion 22 of the plate-receiving metal frame 20, and further engaging the second engagement portion 15 of the plate 10 with the second protrusion 23. In other words, the first engagement portion 14, the second engagement portion 15, the first protrusion 22 and the second protrusion 23 are arranged to have a positional relationship in which, when each of the first engagement portion 14 and the second engagement portion 15 is engaged with a respective one of the first protrusion 22 and the second protrusion 23, the fitting concave portion 16 of the plate 10 and the fitting convex portion 21 of the plate-receiving metal frame 20 are conformably fitted together. This allows the fitting concave portion 16 of the plate 10 to be easily fitted onto the fitting convex portion 21 of the plate-receiving metal frame 20.

Further, in this embodiment, the center line of the groove 14*a* of the first engagement portion 14 in the sliding direction, the center line of the groove 15*a* of the second engagement portion 15 in the sliding direction, the center of the first protrusion 22, and the center of the second protrusion 23, are arranged to have a relationship in which they are located on the central axis C of the plate in the sliding direction. This arrangement makes it possible to reduce a misalignment in the horizontal direction (direction perpendicular to the sliding direction) during the operation of fitting the fitting concave portion 16 of the plate 10 to the fitting convex portion 21 of the plate-receiving metal frame 20. In addition, the plate 10 is supported by one point as a center of gravity thereof, so that, even if it is a heavy component, it can be safely handled in a well balanced manner during the attaching operation. Further, during the attaching operation, a position of the plate 10 in the horizontal direction can be easily corrected.

In this embodiment, the backplate 12, the first engagement portion 14 and the second engagement portion 15 are composed of a single metal plate having a thickness of 4 mm. That is, the first engagement portion 14, the second engagement portion 15 and the fitting concave portion 16 can be formed from a single metal plate by machining, so that it becomes possible to significantly enhance dimensional accuracy thereof Further, a load imposed on each of the first engagement portion 14 and the second engagement portion 15 during the operation of attaching the plate 10 to the plate-receiving metal frame 20 is no more than about the weight of the plate 10, so that it becomes possible to reduce a size of each of these engagement portions. For example, each of the first and second engagement portions 14, 15 may have a width of 10 to 100 mm, a thickness of 2 to 10 mm and a length of 10 to 100 mm. In this embodiment, the refractory plate member 11 has an overall length in the sliding direction of 350 mm, and the metal band 12 has a thickness of 3 mm. The backplate 13 has a thickness of 4 mm, and each of the first and second engagement portions 14, 15 has a length of 30 mm, a width of 35 mm. Each of the grooves has a width of 16 mm and a length of 20 mm, and each of the first and second protrusions 22, 23 has a circular columnar shape with a diameter of 15 mm. In this embodiment, the first engagement portion 14 and the second engagement portion 15 are formed from a single metal plate together with the backplate 13 by machining. Alternatively, each of the first and second engagement portions 14, 15 may be provided by fixing an independent metal plate therefor to the backplate 13 using fixing means such as welding. Further, in this embodiment, the grooves are provided in the first and second engagement portions 14, 15 to allow the first and second protrusions 22, 23 to be engaged therewith. Alternatively, a through-hole may be provided in place of each of the grooves.

In this embodiment, with a view to allowing each of the first and second engagement portions 14, 15 of the plate 10 to be reduced in weight and preventing it from hindering handling of the plate, the groove is provided in the engagement portion. Alternatively, a protrusion may be formed as each of the engagement portions, and a groove or through-hole may be formed as each of the support portions of the plate-receiving metal frame.

Further, an upside down arrangement with respect to this embodiment may be employed, that is, an arrangement may be employed in which, during the plate replacement work, the first engagement portion and the first support portion are located on a relatively upper side, and the second engagement portion and the second support portion are located on a relatively lower side. In this case, for example, the first engagement portion located on the upper side is provided with a through-hole, and the plate-receiving metal frame is provided with a first protrusion, wherein the fitting concave portion of the plate and the fitting convex portion of the plate-receiving metal frame can be set to positionally conform to each other in the sliding direction, and the weight of the plate can be supported, by inserting the first protrusion into (engaged with) the through-hole of the engagement portion to support the first engagement portion in such a manner as to be suspended by the first protrusion. Then, the fitting concave portion of the plate and the fitting convex portion of the plate-receiving metal frame can be set to positionally conform to each other in the direction perpendicular to the sliding direction, by engaging the second engagement portion located on the lower side with the second support portion. Further, each of the first engagement portion, the second engagement portion, the first support portion and the second support portion may be provided in a plural number.

Further, opposite to this embodiment, it is to be understood that the plate 10 may be provided with a fitting convex portion, and the plate-receiving metal frame 20 may be provided with a fitting concave portion. Further, the fitting concave portion in the back surface region of the plate 10 may be formed in only the backplate 13 covering the back surface of the plate 10, as in this embodiment, or may be formed by cutting out the backplate 12 and further forming a recess in the refractory plate member 11. Further, a concave or convex portion may be directly formed in the refractory plate member 11 without using the backplate.

The plate fixing structure according to this embodiment further comprises a latch mechanism 30 as a retainer for detachably locking the plate 10 while non-disengageably retaining an engagement between the second engagement portion 15 and the second protrusion 23 located on a relatively upper side.

During usage, a contact pressure is loaded on the plate 10, and therefore a situation never occurs where the plate 10 is disengaged from the plate-receiving metal frame 20. On the other hand, during the plate replacement work, the plate is set in a vertically extending posture as illustrated in FIG. 1, and the contact pressure is released. Thus, in this state where the first and second engagement portions 14, 15 are simply engaged, respectively, with the first and second protrusions 22, 23, while allowing the fitting concave portion 16 of the plate 10 to be filled to the fitting convex portion 21 of the plate-receiving metal frame 20, the plate 10 is likely to fall toward the sliding surface side due to shock occurring when the metal frame is opened. Thus, it is desirable that, in the state in FIG. 1, the engagement portion of the plate 10 is detachably locked. As a retainer for such locking, a commonly-used locking mechanism may be employed. For example, any suitable heretofore-known mechanism such as a latch, a locking bar, a cam or a pin may be used.

Figure 3:
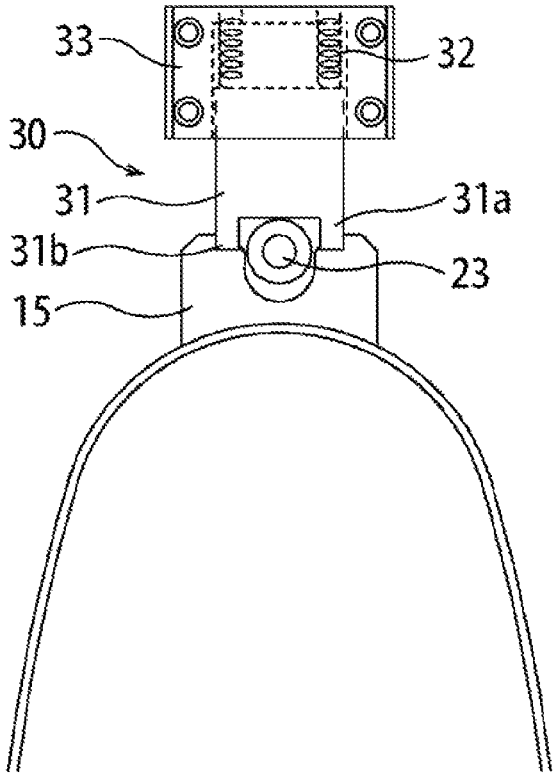
FIG. 3 enlargedly illustrates a latch mechanism and its vicinity in FIG. 1, wherein FIG. 3(*a*) and FIG. 3(*b*) are, respectively, a plan view and a side view thereof.
Figure 3:
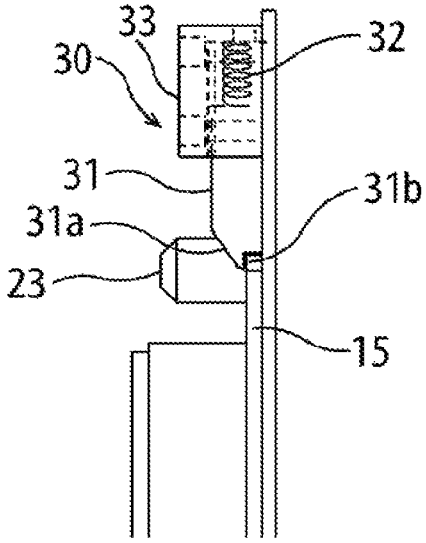

In the embodiment in FIG. 1, a latch mechanism 30 may be used as the locking mechanism. FIG. 3 enlargedly illustrates the latch mechanism 30 and its vicinity in FIG. 1, wherein FIG. 3(*a*) and FIG. 3(*b*) are, respectively, a plan view and a side view thereof.

A latch pawl 31 is retractably attached to a latch body 33 via a coil spring 32. In a normal state, the latch pawl 31 is kept at a protruded position by a biasing force of the coil spring 32. The latch pawl 31 has a distal end portion formed as a fork-like portion branched to stride the second protrusion 23. Each of the branched ends has a inclined surface 31*a* inclined toward the back surface (non-sliding surface) of the plate, and a distal end of the inclined surface has a locking portion 3 lb formed on the side of the back surface to lock the second engagement portion 15. That is, a distal end of the second engagement portion 15 is locked by the locking portion 31*b* in the distal end of the latch pawl 31, so that the engagement between the second engagement portion 15 and the second protrusion 23 is non-disengageably retained to allow the plate 10 to be detachably locked.

In the above configuration, in an operation of fixing the plate 10 to the plate-receiving metal frame 20, the inner surface 14*b* of the groove 14*a* in the first engagement portion 14 of the plate 10 located on the lower side in FIG. 1 is firstly brought into contact with the side surface 22*a* of the first protrusion 22 of the plate-receiving metal frame 20 to supportably engage the first engagement portion 14 with the first protrusion 22. Through this operation, the fitting concave portion 16 of the plate 10 and the fitting convex portion 21 of the plate-receiving metal frame 20 positionally conform in the sliding direction.

Then, the groove 15*a* in the second engagement portion 15 of the plate 10 located on the upper side in FIG. 1 is engaged with the second protrusion 23 of the plate-receiving metal frame 20. Thus, the side surface 23*a* of the second protrusion 23 is guided by the two opposed guide surfaces 15*b* of the groove 15*a* of the second engagement portion 15, so that the fitting concave portion 16 of the plate 10 and the fitting convex portion 21 of the plate-receiving metal frame 20 positionally conform to each other in the direction perpendicular to the sliding direction. In other words, it becomes possible to enhance accuracy of parallelism between each of the surfaces of the fitting concave portion 16 perpendicular to the sliding direction and each of the surfaces of the fitting convex portion 21 perpendicular to the sliding direction. In this embodiment, in this state, a positional relationship is achieved in which a gap between corresponding ones of the vertical surfaces is 0.25 mm on one side. As a result, the fitting concave portion 16 of the plate 10 is fitted onto the fitting convex portion 21 of the plate-receiving metal frame 20.

When the fitting concave portion 16 of the plate 10 is fitted onto the fitting convex portion 21 of the plate-receiving metal frame 20, counterpart ones of the inner surface 14*b* of the groove 14*a* in the first engagement portion 14 of the plate 10 and the side surface 22*a* of the first protrusion 22 of the plate-receiving metal frame 20, and/or counterpart ones of a lower side surface of the fitting concave portion 16 of the plate 10 and a lower side surface of the fitting convex portion 21 of the plate-receiving metal frame 20, are in a contact state. Even if a certain level of dimensional error occurs, it is possible to ensure the fitting, for example, by providing a taper or the like at a distal end of the fitting convex portion 21. In this case, the fitting is achieved while lifting the plate 10 by the taper.

As above, in the above embodiment, the first engagement portion 14 is provided at one of the sliding-directionally opposite ends of the plate which is located on a relatively lower side during the plate replacement work, and the second engagement portion 15 is provided at the other end located on a relatively upper side. Thus, in the plate attaching operation, the weight of the plate 10 is supported by the first protrusion 22 located on the lower side, so that a center of gravity thereof is shifted downward to reduce a worker's load. In addition, in the above embodiment, the backplate 13 and the two engagement portions 14, 15 are formed of a single metal plate. Thus, the grooves and the cutout for the fitting concave portion can be formed in single metal plate by press forming or machining, so that it becomes possible to significantly enhance dimensional accuracy of the grooves and the fitting concave portion.

In the above embodiment, during a process of engaging the second engagement portion 15 with the second protrusion 23, the distal end of the second engagement portion 15 is butted against the inclined surfaces 31*a* of the distal end of the latch pawl 31 of the latch mechanism 30 illustrated in FIG. 3. Then, when the second engagement portion 15 is pushed toward the back surface side so as to fully engage the second engagement portion 15 with the second protrusion 23, the distal end of the second engagement portion 15 is moved on the inclined surfaces 31*a* of the distal end of the latch pawl 31, while retracting the latch pawl 31. Then when the distal end of the second engagement portion 15 passes through distal edges of the inclined surfaces 31*a*, the distal end of the second engagement portion 15 is fitted into and locked by the locking portions 31*b* of the latch pawl 31. Through this operation, the plate 10 is detachably locked.

On the other hand, in an operation of extracting the plate 10 from the plate-receiving metal frame 20, the latch pawl 31 of the latch mechanism 30 is retracted to release the engagement between the latch pawl 31 and the second engagement portion 15. Then, the engagement between the second engagement portion 15 and the second protrusion 23 is released, and finally the engagement between the first engagement portion 14 and the first protrusion 22 is released.

One example of a retainer as substitute for the latch mechanism 30 will be described below.

Figure 4:
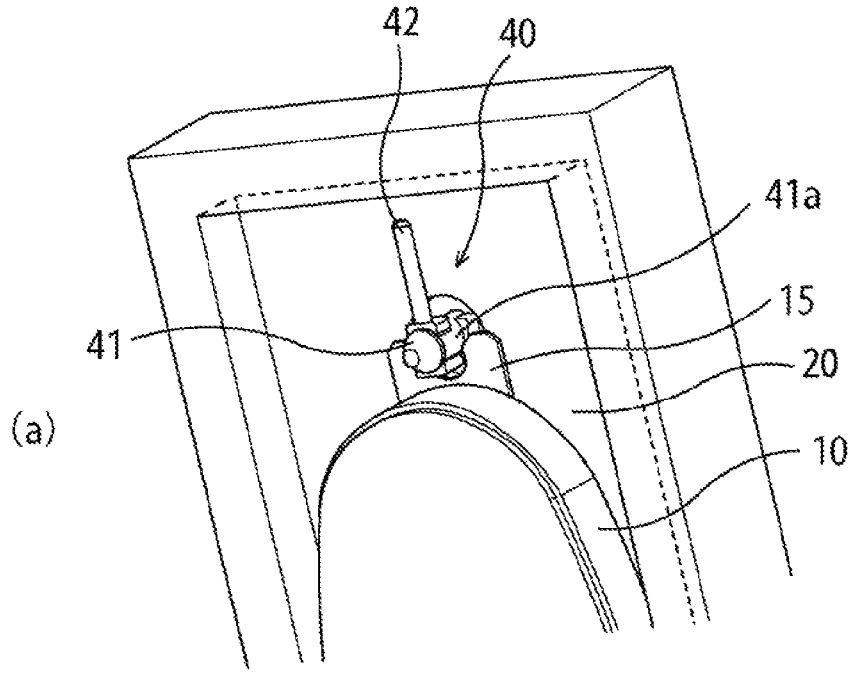
FIG. 4 illustrates a cam mechanism serving as a retainer for detachably locking a plate, wherein FIG. 4(*a*) is a perspective view of a state before locking the plate, and FIG. 4(*b*) is a perspective view of a state after locking the plate.
Figure 4:
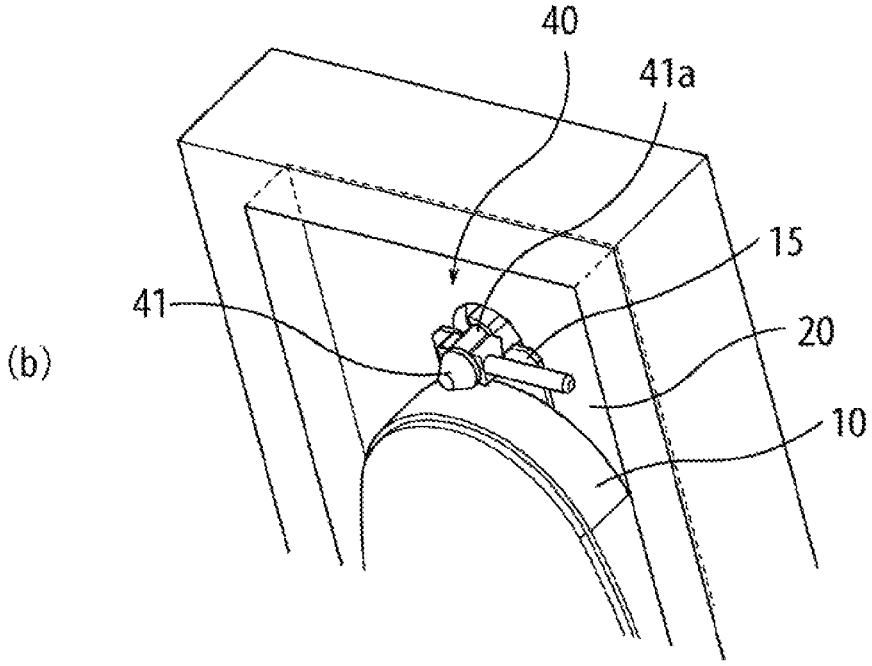
Figure 5:
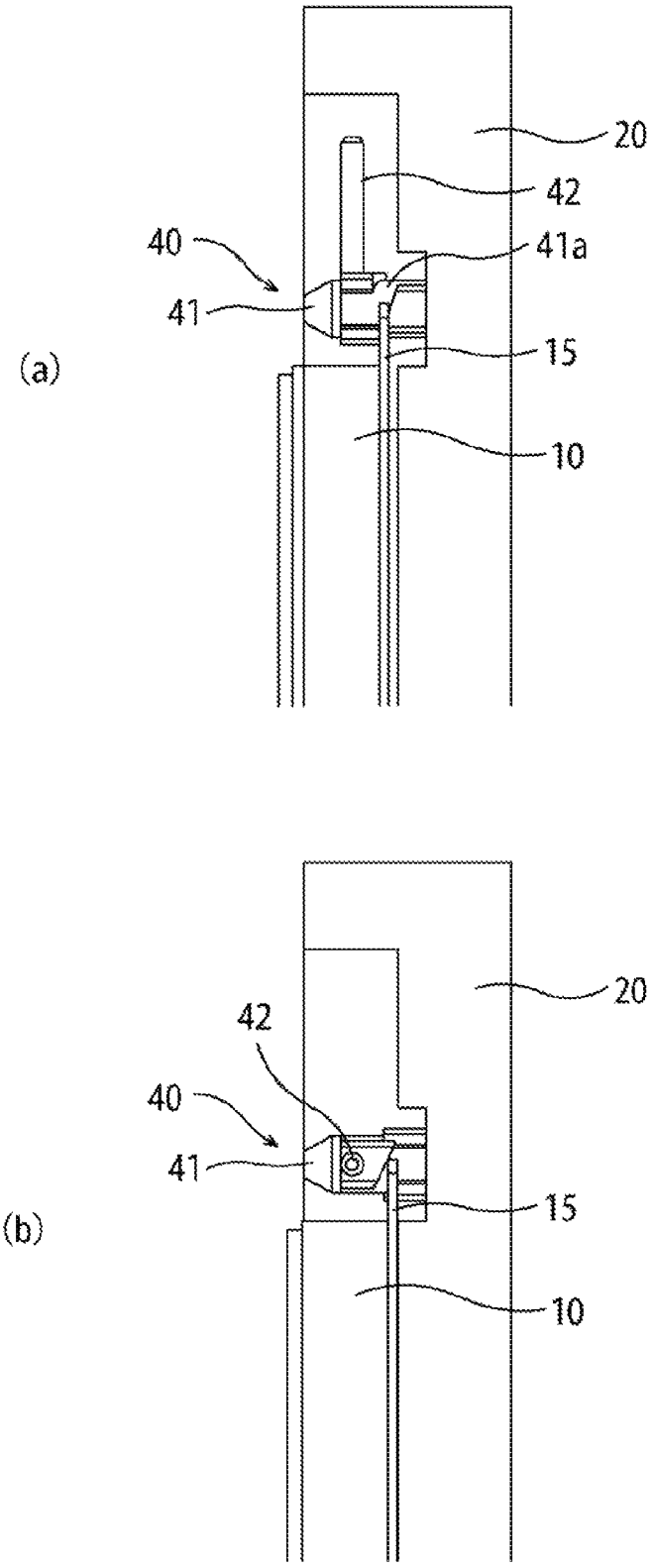
FIG. 5 illustrates the cam mechanism in FIG. 4, wherein FIG. 5(*a*) is a side view of the state before locking the plate, and FIG. 5(*b*) is a side view of the state after locking the plate.

FIGS. 4 and 5 illustrate a cam mechanism 40 serving as a retainer. FIGS. 4(*a*) and 4(*b*) are perspective views of the cam mechanism 40 and its vicinity, and FIGS. 5(*a*) and 5(*b*) are side views thereof, wherein FIGS. 4(*a*) and 5(*a*) illustrate a state before locking the plate, and FIGS. 4(*b*) and 5(*b*) illustrate a state after locking the plate.

In the cam mechanism 40, a circular cylindrical or circular columnar-shaped cam body 41 is attached to the plate-receiving metal frame 20 rotatably about a central axis thereof, and a spiral-shaped cam groove 41*a* is formed in an outer periphery of the cam body.

In a state in which the second engagement portion 15 of the plate 10 is engaged with the cam body 41 serving as a second protrusion, the second engagement portion 15 is located on a surface of the cam groove 41*a* on the side of the back surface (non-sliding surface), as illustrated in FIGS. 4(*a*) and 5(*a*). Then, when the cam body 41 is rotated 90 degree according to a manual operation of a lever 42 coupled to the cam body 41, the second engagement portion 15 is kept in a state in which it is pressed toward the non-sliding surface side (toward the side of the plate-receiving metal frame 20) by a surface of the cam groove 41*a* on the side of the sliding surface, as illustrated in FIGS. 4(*b*) and 5(*b*). Through this operation, the engagement between the second engagement portion 15 and the can body 41 is non-disengageably retained to allow the plate 10 to be detachably locked.

In an operation of extracting the plate 10 from the plate-receiving metal frame 20, the cam body 41 is rotated 90 degrees in a reverse direction according the manual operation of the lever 42, and returned to the state illustrated in FIGS. 4(*a*) and 5(*a*). In this state, the engagement between the second engagement portion 15 and the cam body 41 can be released. Further, as is clear from FIG. 4(*a*), the plate 10 is separated from the plate-receiving metal frame 20. This makes it possible to facilitate separation from the casting nozzle joined to the plate 10, such as an upper nozzle.

Figure 6:
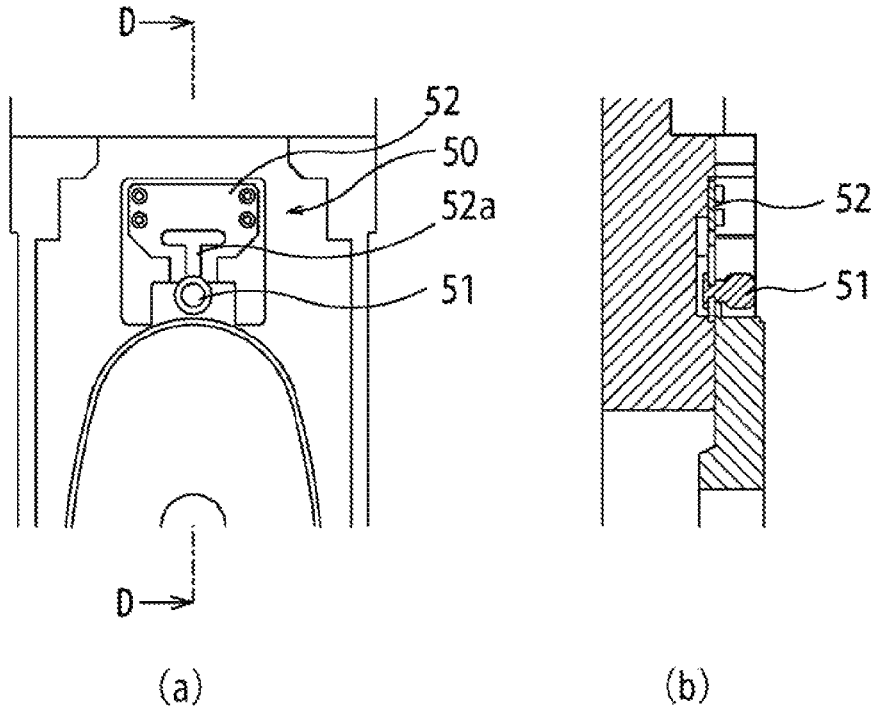
FIG. 6 illustrates a slide pin mechanism serving as a retainer for detachably locking a plate, wherein FIG. 6(*a*) is a plan view of the slide pin mechanism, and FIG. 6(*b*) is a sectional view taken along the line D-D in FIG. 6(*a*).

FIG. 6 illustrates an example where a slide pin mechanism 50 is used as a retainer, wherein FIG. 6(*a*) is a plan view thereof, and FIG. 6(*b*) is a sectional view taken along the line D-D in FIG. 6(*a*).

A guide plate 52 is fixed to the plate-receiving metal frame 20 to guide a slide pin 51. The guide plate 52 is formed with a T-shaped guide groove 52*a*, the slide pin 51 is provided in such a manner as to be slidingly movable along the guide groove 52*a*.

Figure 7:
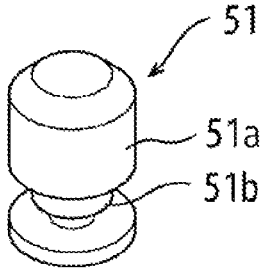
FIG. 7 is a perspective view of a slide pin for use in the slide pin mechanism in FIG. 6.

The slide pin 51 also functions as a second protrusion for allowing the second engagement portion 15 to be engaged therewith. That is, as illustrated in FIG. 7, the slide pin 51 has a head portion 51*a*, and a small-diameter portion 51*b* formed just below the head portion 51*a* to have a diameter less than that of the head portion 51*a*. The small-diameter portion 51*b* is configured to be fitted into a concave-shaped groove in the distal end of the second engagement portion 15, thereby allowing the second engagement portion 15 to be engaged with the slide pin 51. The groove of the second engagement portion 15 has a groove width less than a diameter of the head portion 51*a* of the slide pin 51 and slightly greater than the diameter of the small-diameter portion 51*b*. The groove width of the guide groove 52*a* is also less than the diameter of the head portion 51*a* of the slide pin 51 and slightly greater than the diameter of the small-diameter portion 51*b*.

In an operation of engaging the second engagement portion 15 of the plate 10 with the slide pin 51 serving as the second protrusion, in a state in which the slide pin 51 is retracted toward an upper region of the guide groove 52*a*, the concave-shaped groove in the distal end of the second engagement portion 15 is set to positionally conform to a region of the guide groove 51*a* extending in an up-down direction. Then, the slide pin 51 is moved downwardly by its own weight. Thus, the small-diameter portion 51*b* of the slide pin 51 is fitted into the concaved-shaped groove in the distal end of the second engagement portion 15, so that the second engagement portion 15 is engaged with the slide pin 51. In this state, the head portion 51*a* of the slide pin 51 is located in overlapped relation with the second engagement portion 15. Thus, the engagement between the second engagement portion 15 and the slide pin 51 is non-disengageably retained to allow the plate 10 to be detachably locked.

In an operation of extracting the plate 10 from the plate-receiving metal frame 20, the slide pin 51 may be retracted toward the upper region of the guide groove 52*a*. The retracted slide pin 51 may be located in a horizontally-extending region of the T-shaped groove 52*a*. This prevents the slide pin 51 to move downwardly during the replacement work for the plate 10 to hinder the work.

In the above embodiment, the retainer (the latch mechanism 30, the cam mechanism 40, the slide pin mechanism 50) is disposed at an engagement position between the second engagement portion 15 and the second protrusion 23 located on the upper side during the plate replacement work. Alternatively, it may be disposed at an engagement position between the first engagement portion 14 and the first protrusion 22, or may be disposed at both of the engagement positions. However, in the present invention, it is only necessary to provide the retainer at only one of the engagement positions, and, in view of workability, it is preferable to provide it at the engagement position between the second engagement portion 15 and the second protrusion 23 located on the upper side during the plate replacement work, as in the above embodiment. It is to be understood that the retainer is not limited to the configurations described in the above embodiment, but any other suitable configuration capable of detachably locking the plate may be used.

EXPLANATION OF CODES

10: plate
11: refractory plate member
11*a*: nozzle hole
12: metal band
13: backplate
14: first engagement portion
14*a*: groove in first engagement portion
14*b*: inner surface of groove (contact surface)
15: second engagement portion
15*a*: groove in second engagement portion
15*b*: guide surface
16: fitting concave portion
20: plate-receiving metal frame
21: fitting convex portion
22: first protrusion (first support portion)
22*a*: side surface of first protrusion (contact surface)
23: second protrusion (second support portion)
23*a*: side surface of second protrusion (guide surface)
30: latch mechanism (retainer)
31: latch pawl
31*a*: inclined surface
31*b*: locking portion
32: coil spring
33: latch body
40: cam mechanism (retainer)
41: cam body

41*a*: cam groove
42: lever
50: slide pin mechanism (retainer)
51: slide pin
51*a*: head portion
51*b*: small diameter portion
52: guide plate
52*a*: guide groove
C: central axis of plate in sliding direction

What is claimed is:

1. A plate-fixing structure for fixing a plate to a plate-receiving metal frame in a sliding nozzle device, the plate-fixing structure comprising:

a plate having a fitting convex or concave portion in a back surface region thereof, a first engagement portion extending outwardly from one end thereof in a sliding direction, and a second engagement portion extending outwardly from an opposite end thereof; and a plate-receiving metal frame having a corresponding fitting convex or concave portion, a first support portion for engaging with the first engagement portion, and a second support portion for engaging with the second engagement portion; wherein when the first engagement portion is engaged with and supported by the first support portion, the fitting convex or concave portion of the plate and the corresponding fitting convex or concave portion of the plate-receiving metal frame fit together and positionally conform to each other in the sliding direction, and when the second engagement portion is engaged with and supported by the second support portion, the fitting convex or concave portion of the plate and the corresponding fitting convex or concave portion of the plate-receiving metal frame fit together and positionally conform to each other in a direction perpendicular to the sliding direction.

2. The plate-fixing structure according to claim 1, wherein the back surface region of the plate has a backplate made of metal, the first engagement portion extends outwardly from one end of the backplate in the sliding direction, and the second engagement portion extends outwardly from an opposite end of the backplate in the sliding direction.

3. The plate-fixing structure according to claim 1, wherein, during plate replacement, the first engagement portion is located on a lower side of the plate and the second engagement portion is located on an upper side of the plate.

4. The plate-fixing structure according to claim 1, wherein the first and second engagement portions and the first and second support portions are located on a central axis of the plate when fitted together and engaged.

5. The plate-fixing structure according to claim 1, further comprising a retainer for non-disengageably retaining at least one of the engagement of the first engagement portion with the first support portion and the engagement between the second engagement portion and the second support portion.

6. The plate-fixing structure according to claim 5, wherein the retainer is selected from the group of mechanisms consisting of a latch, a locking bar, a cam, a pin, and combinations thereof.

7. A plate for use with a plate-fixing structure of a sliding nozzle device, the plate comprising:

a fitting convex or concave portion in a back surface region thereof;

a first engagement portion extending outwardly from one end thereof in a sliding direction, the first engagement portion engageable with a first support portion of a plate-receiving metal frame; and a second engagement portion extending outwardly from an end opposite the first engagement portion; the second support portion engageable with a second support portion of a plate-receiving metal frame; wherein the plate is fixed to a plate-receiving metal frame by fitting the fitting convex or concave portion to a corresponding fitting convex or concave portion of the plate-receiving metal frame through engagement of the first engagement portion with the first support portion of a plate-receiving metal frame and engagement of the second engagement portion with the second support portion of a plate-receiving metal frame.

8. The plate according to claim 7, wherein the back surface region has a backplate made of metal, the first engagement portion extends outwardly from one end of the backplate in the sliding direction, and the second engagement portion extends outwardly from an opposite end of the backplate in the sliding direction.

9. The plate according to claim 7, wherein, during plate replacement, the first engagement portion is located on a lower side and the second engagement portion is located on an upper side.

10. The plate according to claim 7, wherein the first and second engagement portions are located on a central axis of the plate in the sliding direction.

11. A plate-fixing structure for fixing a plate to a plate-receiving metal frame in a sliding nozzle device, the plate-fixing structure comprising:

a plate having a fitting convex or concave portion in a back surface region thereof, a backplate made of metal on the back surface region, a first engagement portion extending outwardly from one end of the backplate in the sliding direction, and a second engagement portion extending outwardly from an opposite end of the backplate in the sliding direction; and a plate-receiving metal frame having a corresponding fitting convex or concave portion, a first support portion for engaging with the first engagement portion, and a second support portion for engaging with the second engagement portion; wherein when the first engagement portion is engaged with and supported by the first support portion, the fitting convex or concave portion of the plate and the corresponding fitting convex or concave portion of the plate-receiving metal frame fit together and positionally conform to each other in the sliding direction, and when the second engagement portion is engaged with and supported by the second support portion, the fitting convex or concave portion of the plate and the corresponding fitting convex or concave portion of the plate-receiving metal frame fit together and positionally conform to each other in a direction perpendicular to the sliding direction.

* * * * *